US005842933A

United States Patent [19]

Lewis

[11] Patent Number: 5,842,933

[45] Date of Patent: Dec. 1, 1998

[54] IMPLEMENT GRIP WITH BUILT-IN SHOCK ABSORBER

[76] Inventor: William H. Lewis, P.O. Box 12068, Alexandria, La. 71315

[21] Appl. No.: 772,138

[22] Filed: Dec. 19, 1996

[51] Int. Cl.[6] ..... A63B 49/00

[52] U.S. Cl. ..... 473/300; 473/318; 473/520; 473/521

[58] Field of Search ..... 473/300, 318, 473/520, 564, 566, 567, 521; 81/20, 22, 489

[56] References Cited

U.S. PATENT DOCUMENTS

| | | | |
|---|---|---|---|
| 2,124,534 | 7/1938 | Barnhart | 473/300 |
| 3,964,340 | 6/1976 | Antonio et al. | 473/300 |
| 5,362,046 | 11/1994 | Sims | 473/318 |
| 5,380,003 | 1/1995 | Lanctot | 473/520 |
| 5,478,075 | 12/1995 | Saia et al. | 473/318 |
| 5,607,362 | 3/1997 | Haber et al. | 473/318 |

*Primary Examiner*—Mark S. Graham
*Attorney, Agent, or Firm*—Joby A. Hughes

[57] ABSTRACT

An implement grip having a built-in shock absorber. The shock absorber may have a coiled configuration or interspersed coils. Implements range from sports equipment such as golf clubs, tennis rackets, and baseball bats to tools such as hammers.

6 Claims, 1 Drawing Sheet

IMPLEMENT GRIP WITH BUILT-IN SHOCK ABSORBER

TECHNICAL FIELD OF THE INVENTION

The present invention relates to novel, improved methods and systems for absorbing and dampening the shock and vibrations associated with the swinging and subsequent impact of a golf club or other sports implement in order to minimize the shock and vibration to the user of the implement.

BACKGROUND

This invention relates to several implements including but not limited to golf clubs, tennis rackets, baseball and softball bats, and hammers. Any implement which is swung by a human and subsequently strikes an object generally generates vibrations through the shaft of the implement. These vibrations are then transmitted into the hands of the holder of the implement. For example, in swinging a golf club, the impact of the club striking the ball creates vibrations in the shaft of the club. These vibrations, when transmitted to the hands of the player can create a stinging sensation in the hands and can eventually cause injury to the hands of the user. This stinging feeling, caused by the vibrations, leads to alterations in the swinging of the implement, gripping of the implement, and other phenomenon which may adversely affect a player's performance. These vibrations also subject the user of the implement to injury, either through one catastrophic impact which immediately injures the user or through repeated fatigue in the hands, arms or even the shoulders of the user. Relevant examples of injury include carpal tunnel syndrome and tennis elbow.

Others have attempted to solve the problems attributable to impact-generated vibrations with vibration dampers in or attached to the handle of an implement. See U.S. Pat. No. 5,362,046 issued on Nov. 8, 1994 to Simms. There are several drawbacks to this approach. First, it employs a mushroom shaped plug which is installed into the end of the implement wherein a grip is mounted over the top of the implement. In many implements, especially in tennis racquets and golf clubs, this type of plug would adversely affect the swing weight and balance of the overall club. Many clubs, especially those designed for original equipment manufacture, depend on the application of the swing weight and balance being consistent through a series of clubs or racquets. This is not possible with the plug effect wherein it is also applied in the exact same manner as an implement that does not employ the plug.

Second, plugs can protrude through the grip which is mounted over the plug. In addition, the plug in most instances will require that the grip or the shaft be altered to allow for the extra space. This is because generally the grip is manufactured to be close fitting and stretched over the racquet or golf club. This close fitting nature of the grip onto the implement is further required because of the need for the grip not to turn or to lose the grip on the shaft while swinging. Because tennis racquets and golf clubs, and hammers for that matter, are swung at a high rate of speed, the resulting closeness between the grip and shaft must be extremely snug. The protrusion of the plug therefore will be fairly great and over time will slowly fatigue and reduce the wear of the grip at the butt end through working its way through the grip.

The plug requires a greater expense both in being installed and in manufacture. In addition, the plug must be relatively physically rigid to keep its shape and allow for accurate and non-deformed insertion, which limits its ability to apply a dampening effect.

SUMMARY OF THE INVENTION

There have now been invented and disclosed herein certain new and novel golf club grips with built-in shock absorber and vibration dampening systems which have the advantage over those heretofore proposed in that the built-in shock absorber is integral to and a part of the construction of the implement's grip. As a result, the shock absorber built into the grip allows for designing and weighting the grip in such a manner that the swing weight and balance of the club are taken into effect. In addition, there is no plug to protrude through the grip became it is a part of the grip. In addition, the structure of the grip and the shock absorber do not have to be compromised with regard to shape, size, density of materials and rigidity to provide optimal absorption. The mounting of the shock absorber to the grip further allows secure mounting of the damping feature, whereas the aforementioned plug must have a higher, closer tolerance because it must be secured and provide damping at the same points. This is a result of the fact that the plug must be separately installed and provide its own points to be secured to the inside of the shaft of the implement whereas the improved shock absorber built into the grip allows the shock absorber to reside on the grip which is mounted to the outside of the shaft. This therefore increases the feel and also provide a more secure feel to the wielder of the implement.

The grip with the built-in shock absorber therefore absorbs more vibrations because it can be less rigid due to the fact that it does not have to secure itself within the shaft but is attached to the grip, which is secured to the outside of the shaft. There is also less error in mounting because the grip and plug are already integrally mounted together and pre-aligned. There is therefore no more work in applying a grip with the built-in shock absorber than applying a standard grip.

This last design feature is especially important in the replacement grip market for sports implements such as golf clubs and tennis racquets. With the built-in shock absorber, the golf grip or tennis grip is easily mounted in a one step process the same way that a regular grip without a shock absorber would be mounted. After the insertion of a plug, as taught in the prior art, it would be difficult or impossible to first mount the plug and then alter the grip for swing weight and fit on each and every club.

The built-in shock absorber distends from the grip immediately adjacent to the end of the implement. The built-in shock absorber may be arranged in a coiled manner or in any other arrangement that provides contact with the inner surface of the shaft of the implement. The built-in shock absorber may have several other damping configurations including a plurality of coils or other configurations commonly known in the field of damping.

The objects, features and advantages of the invention will be apparent to the reader from the foregoing and the appended claims and as the ensuing detailed description and discussion of the invention proceeds in conjunction with the accompanying claims.

DETAILED DESCRIPTION OF THE INVENTION

Figure 1:
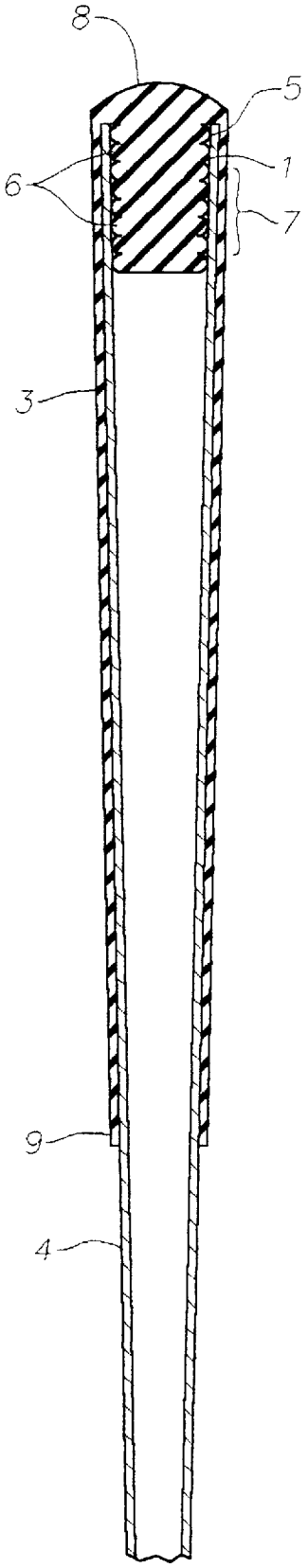
FIG. 1 is a perspective view of the grip end of a golf club equipped with an energy absorbing shock-absorber embodying the principles of the invention.
Figure 2:
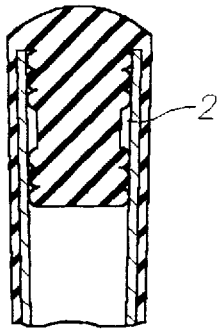
FIG. 2 is a view of an alternative shock-absorber design embodying the principles of the invention.

Referring now to the drawing, FIG. 1 depicts a vibration dampening shock-absorber 1 embodying the principles of the present invention; and FIG. 2 depicts an alternative shock-absorber design 2 embodying the principles of the present invention.

The vibration dampening shock-absorber 1 illustrated in FIG. 1 has a circular cross section and a spring-like configuration consisting of "coils" 6. The implement, in this case a golf club shaft 4, has a conventional hollow handle with an exposed or free end 5. The golf club grip 3 has a closed end 8 and an open end 9 and is generally in a frustroconical shape.

Unlike previous inventions, the vibration dampening shock-absorber 1 is not inserted into the exposed or free end 5 of the golf club shaft 4. The vibration dampening shock-absorber 1 is assembled as an integral part of the golf club grip 3, thereby allowing the insertion of the vibration dampening shock-absorber into the exposed end 5 of the golf club shaft 4 by sliding the golf club grip 3 until a maximum outer diameter portion of; the shock-absorber 1 rests securely in and against the inner surface of the golf club shaft 4. This is accomplished by engagement of the maximum outer diameter portion of shock-absorber 1 with the inner surface of golf club shaft 4.

The vibration dampening shock-absorber 1 may also be attached to the golf club grip 3 at the closed end 8 with an adhesive, an appropriate mechanism, or through friction between the two surfaces 1 and 3. The outer diameter of the vibration dampening shock absorber 1 matches the inside diameter of the golf club grip 3 at the closed end 8.

The alternate vibration dampening shock-absorber 2 illustrated in FIG. 2 has a circular cross section and a spring-like configuration much like the vibration dampening shock-absorber 1 illustrated in FIG. 1. The difference between these 1 and 2 consists of the absence of the inner "coils" 7 on the alternate vibration dampening shock absorber 2. The alternate vibration dampening shock-absorber 2 can consist of a plurality of coils 6 so long as all coils 6 are not contiguous like the coils 6 in the vibration dampening shock-absorber 1 in FIG. 1.

The invention may be embodied in many forms without departing from the spirit or essential characteristics of the invention. The present embodiments are therefore to be considered in all respects as illustrative and not restrictive. The scope of the invention is indicated by the appended claims rather than the foregoing description. All changes which come within the meaning and range of equivalency of the claims are intended to be embraced therein.

What is claimed is:

1. A sporting implement, comprising:

a shaft with an inner diameter portion;

a grip for the shaft of the sporting implement, the grin having a body with an inner and outer surface, said inner surface generally conforming to an outer configuration of the shaft, which is used by the user of the implement to hold the implement; and a built-in shock absorber which generally conforms to the inner diameter portion of the shaft, said shock absorber is being integrally attached to said body of the grip and having a maximum outer diameter portion which engages the inner diameter portion of the shaft.

2. The implement according to claim 1 wherein the implement is a golf club and the grip has a frustoconical shape, an open end and a closed end.

3. The implement according to claim 1 wherein the implement is a bat and the grip is shaped to fit the bat.

4. The implement according to claim 1 wherein the implement is a racket and the grip is shaped to fit the handle of the racket.

5. The implement according to claim 1 wherein the built-in shock absorber has a configuration in the shape of a coil.

6. The combination of a sporting implement and an external handle grip having a built-in shock absorber which prevents impact generated vibrations from transferring to any device, structure, or body coming in contact with the handle grip, said built-in shock absorber being integrally formed with the handle grip and fabricated from an elastomer, and said built-in shock absorber having a cylindrical, spring-like shape consisting of coils which have a maximum outer diameter portion which engage an inner diameter portion of the sporting implement.

* * * * *